US010363456B2

(12) United States Patent
Melendez

(10) Patent No.: US 10,363,456 B2
(45) **Date of Patent: *Jul. 30, 2019**

(54) PROPULSION SYSTEM FOR USE BY A SWIMMER

(71) Applicant: PROPULSE, LLC, Deerfield Beach, FL (US)

(72) Inventor: Michael Melendez, Pompano Beach, FL (US)

(73) Assignee: PROPULSE, LLC, Deerfield Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/544,076

(22) PCT Filed: Aug. 20, 2015

(86) PCT No.: PCT/US2015/046092

§ 371 (c)(1),
(2) Date: Jul. 17, 2017

(87) PCT Pub. No.: WO2016/118190

PCT Pub. Date: Jul. 28, 2016

(65) Prior Publication Data

US 2017/0361168 A1 Dec. 21, 2017

Related U.S. Application Data

(63) Continuation of application No. 14/600,809, filed on Jan. 20, 2015, now Pat. No. 9,327,165.

(51) Int. Cl.
*A63B 35/12* (2006.01)

(52) U.S. Cl.
CPC ..... *A63B 35/12* (2013.01)

(58) Field of Classification Search
CPC ..... A63B 35/12
See application file for complete search history.

(56) References Cited

U.S. PATENT DOCUMENTS 3,635,188 A 1/1972 Rutkowski
4,700,654 A * 10/1987 Borges ..... A63B 35/12
114/338

(Continued)

FOREIGN PATENT DOCUMENTS

CN 100999251 A 7/2007
GB 2520015 A 5/2015

OTHER PUBLICATIONS

International Search Report and Written Opinion dated Jan. 17, 2016 in connection with International Patent Application No. PCT/US2015/046092, 7 pages.

(Continued)

*Primary Examiner* — Stephen P Avila
(74) *Attorney, Agent, or Firm* — Dorsey & Whitney LLP

(57) ABSTRACT

A propulsion system, for use by a swimmer in both on-water and underwater applications, includes at least one power supply unit attachable about a sleeve secured about a forearm of the swimmer, at least one corresponding propulsion unit including a motor and an impeller, the motor in electrical communication with the motor controller, the propulsion unit within a housing, the unit extending in a direction laterally offset from the forearm, near to the wrist and away from the head of the swimmer; and control apparatus for the power and propulsion units. The control apparatus includes elements for controlling pitch of an axis of the propulsion unit relative to a forearm of the swimmer, the control elements including a pivotally secured bracket, and elements for control of the level of power provided to the propulsion unit, in which each of the rotating and control apparatus are positioned for ease of accessibility by a hand of the swimmer.

20 Claims, 8 Drawing Sheets

(56) References Cited

U.S. PATENT DOCUMENTS

| | | | | |
|---|---|---|---|---|
| 4,732,104 | A * | 3/1988 | Roestenberg | B63H 5/18 114/151 |
| 4,996,938 | A | 3/1991 | Cameron et al. | |
| 5,024,178 | A | 6/1991 | Bruce | |
| 5,509,372 | A | 4/1996 | Culotta | |
| 5,984,739 | A | 11/1999 | Donahue | |
| 6,036,555 | A * | 3/2000 | Takacs | B63H 20/007 440/6 |
| 6,572,422 | B2 | 6/2003 | Kirkwood et al. | |
| 8,567,336 | B1 * | 10/2013 | Mazin | A63B 31/12 114/315 |
| 9,327,165 | B2 * | 5/2016 | Melendez | A63B 35/12 |
| 2002/0049012 | A1 | 4/2002 | Kirkwood et al. | |

OTHER PUBLICATIONS

Extended European Search Report dated Aug. 30, 2018 in connection with European Patent Application No. 15879211.9, 8 pages.
First Notice of Correction dated Jan. 11, 2018 in connection with Chinese Patent Application No. 201590001326.4, 6 pages including English translation.

* cited by examiner

PROPULSION SYSTEM FOR USE BY A SWIMMER

BACKGROUND OF THE INVENTION

1. Field of Invention

The instant invention relates to a device for propulsion of a swimmer through the water and, more particularly, to a device and system which is mounted upon the forearm of the swimmer and which may be controlled by the hands and fingers thereof.

2. Prior Art

There is a demand for propulsion units for use by underwater as well as on-water swimmers, inclusive of snorkelers and scuba divers. As such, the term "swimmer" as used herein, includes on-water swimmers, surfers, underwater swimmers, scuba divers, and others. Certain propulsion units are also employed by lifeguards and certain handicapped or disabled persons. There, as well, is a need for improvement in the prior art of such vehicles by the military. The prior art in the present area includes the range of systems which are power operated, and includes arrangements in which the propulsion unit is attached to the back of a swimmer or about the torso and legs. Art of this nature is represented by U.S. Pat. No. 4,843,998 (1989) to Parker, entitled Submersible Drive Means; U.S. Pat. No. 5,2024,178 (1991) to Bruce, entitled Underwater Propulsion Device; U.S. Pat. No. 6,823,813 (2004) to Mazin, entitled Leg-Mounted Propulsion Device For Swimmers and Divers; and U.S. Pat. No. 6,848,385 (2005) to Mah, entitled Underwater Motor Device. This invention seeks to improve upon such prior art in terms of ease of use and minimizing any encumbrance to the swimmer or diver during the use thereof.

Another type of assembly known to the inventor is one known as the X2 Jet Pack in which one mounts a propulsion means to each forearm. However, in that each unit is fixed and parallel with the forearm, it offers no degree of movement other than that which is physiologically possible by the forearm of the swimmer. Further, the power source and other components of the X2 Jet Pack System are integrated within a body harness that is worn by the swimmer, resulting in power and control cables that are located between the swimmer's body and lower arms. Such cables and harness inherently encumber the swimmer or diver who must at all times be aware of the harness on the body which, in any event, increases the opportunity for snagging. A method of quick release of a thruster and cables in the event of snagging is not taught by or apparent from the X2 Jet Pack. Yet further, both propulsion units (or thrusters) of this system are controlled by a single hand-held button. As such, each thruster of the X2 Jet Pack is not operated independently thereby limiting the degree of control of the system.

Another type of system, similar to that of Matin above, allows the swimmer to insert one forearm through a fixed diameter ring and grasp a fixed control handle with a button. The unit is fixed in parallel with the forearm and offers no additional degrees of movement beyond the swimmer's range of motion of the lower arm. The system's power source and propulsion unit are housed within a dry cylinder having a diameter larger than that of the propeller blade. Further, the batteries of this type of system cannot be changed under water and the unit is bulky to a swimmer.

Also known in the art are a variety of motorized sleds, which are relatively large units and require the swimmer to mount the sled, ride upon it and drive it and as if it were a separate vehicle (which it is). Many back powered units are bulky and, as such, are awkward for a diver to enter and leave the water with. Further, these units do not lend themselves to ease of maneuverability in the water because the propulsion unit is always fixed to the swimmer or to an air tank which in turn is attached to the swimmer.

Other popular swimmer and diver propulsion systems are the SeaDoo Scooter and the Bladefish, both of which require the use of two hands to grip the respective sides thereof.

The present invention thereby provides a propulsion unit of a type fixed to the forearm of a swimmer and which is maneuverable by one hand of the swimmer.

SUMMARY OF THE INVENTION

A propulsion system for use by a swimmer in both on-water or underwater applications, includes at least one power supply unit attachable about a sleeve secured about a forearm of the swimmer; at least one corresponding propulsion unit including a motor and an impeller, the motor in electrical communication with the motor controller, said propulsion unit within a housing, said propulsion unit having a bracket pivotally securing it to said sleeve, said unit extending in a direction laterally offset from said forearm and distally away from the head of the swimmer; and control means for said power and propulsion units, said control means including: (i) means for controlling pitch of an axis of said propulsion unit relative to a forearm of the swimmer, said means including said pivotally secured bracket; and (ii) means for control of a level of power provided by said power unit to said propulsion unit, in which each of said pitch and power control means are positioned for ease of accessibility by a hand of the swimmer, It is an object of the invention to provide a diver with a personally powered propulsion system which enables a user to have a high degree of maneuverability upon and under the water.

It is another object to provide an efficient and effective personal power propulsion system for swimmers and divers which enables the user to have enhanced maneuverability in and under the water and which, during use, can leave the user's hands free for the performance of desired tasks or actions.

It is a further object to provide an underwater propulsion device which has a propulsion unit attached to the forearm of a swimmer that can be used by swimmers, life guards, snorkelers divers, scuba divers and many other types of users.

It is a yet further object to provide a completely hand and wrist-operated under or in-water propulsion system attachable to the forearm of the swimmer in which speed and directionality can be fully controlled by the hand and wrist of the swimmer.

The above and yet other objects and advantages of the present invention will become apparent form the hereinafter set forth Brief Description of the Drawings, Detailed Description of the Invention and Claims appended herewith.

DETAILED DESCRIPTION OF THE INVENTION

In the prior art, a swimmer has a tank on his back which is attached to him by a harness. A power unit is typically provided integrally with an impeller unit upon the tank or about a waist and forearm of a swimmer 10.

Figure 1:
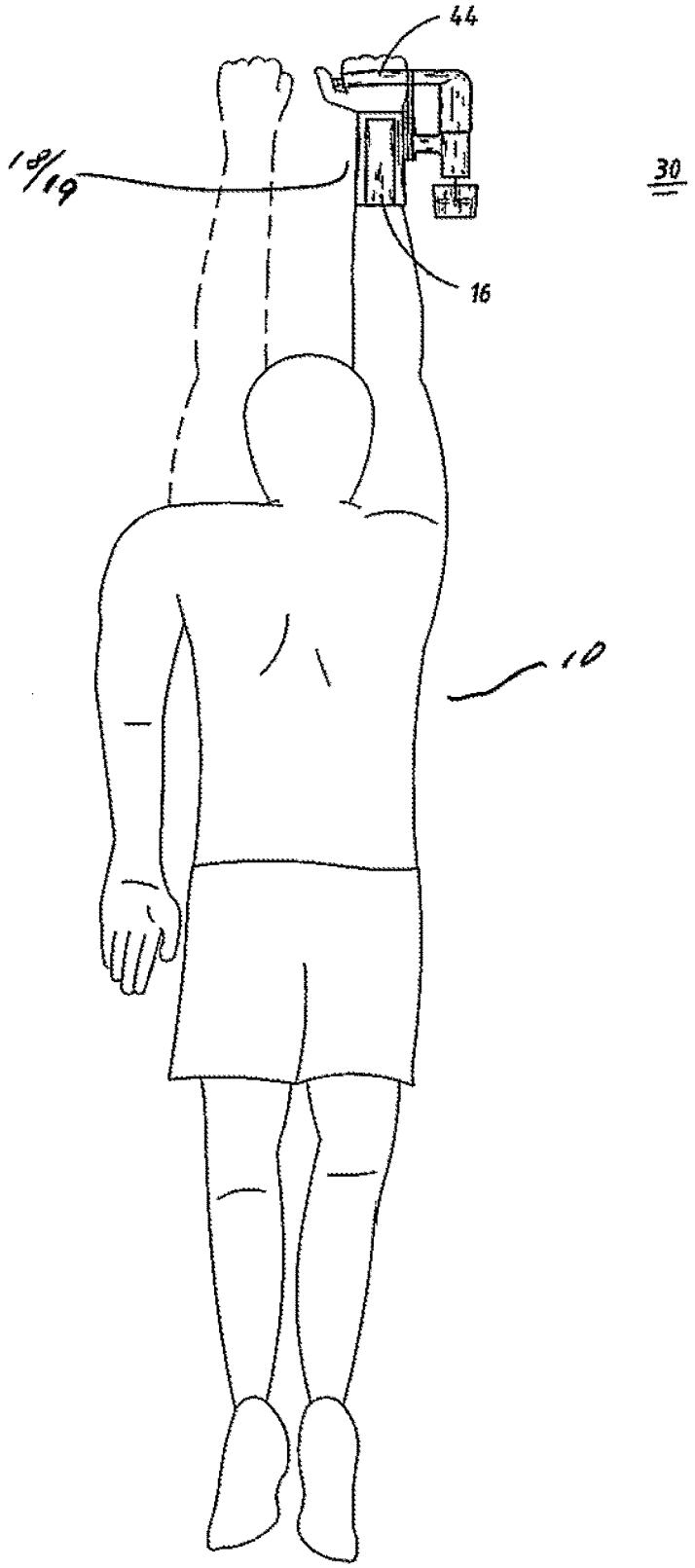
FIG. 1 is a top perspective view showing a swimmer equipped with the inventive propulsion system
Figure 2:
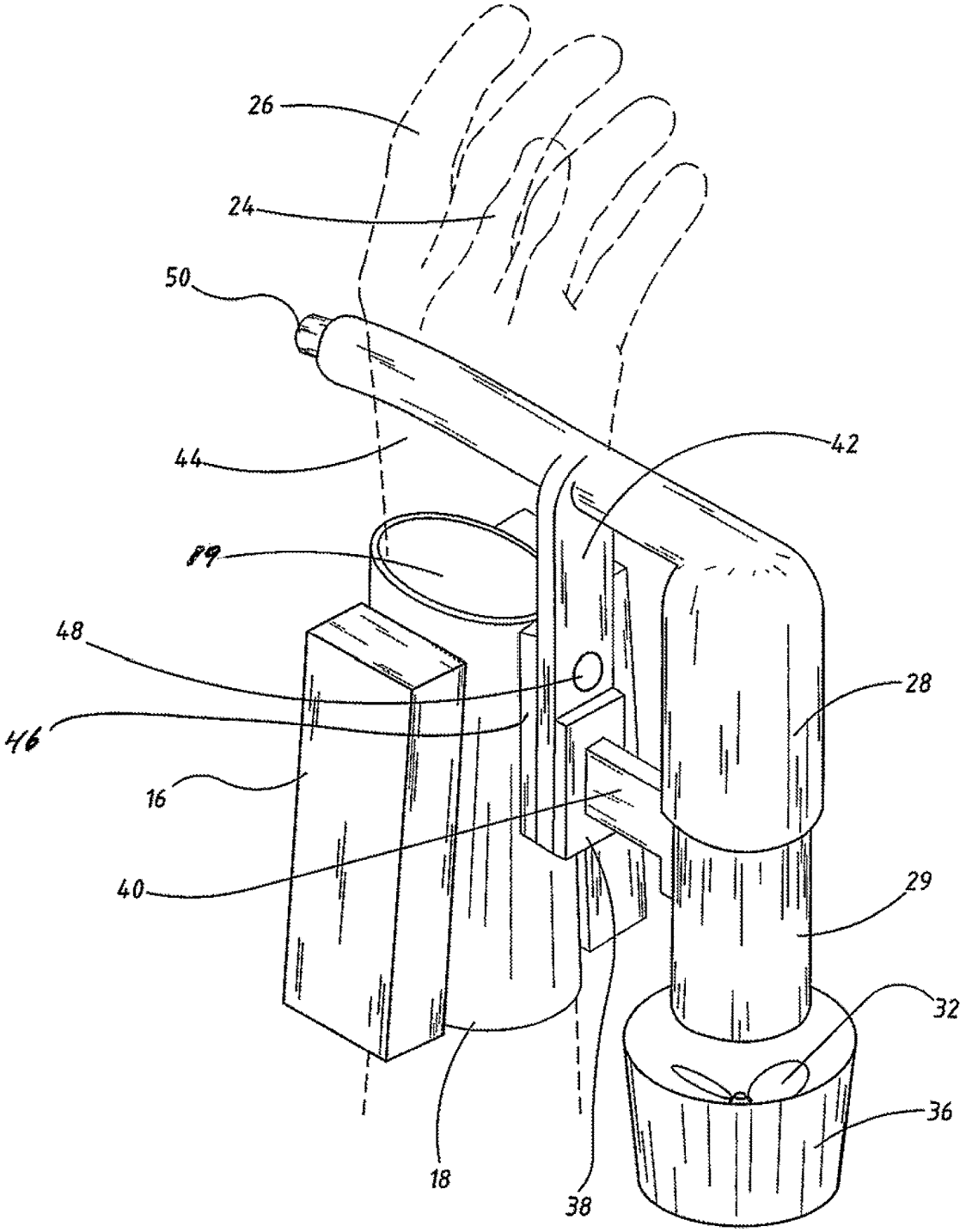
FIG. 2 is a perspective view of the present invention.

In the instant invention, two lithium batteries 16 and 16A (see FIG. 3), serve as the power supply of the system preferably connected in series to achieve an output of about 30V DC, and attached to a sleeve 18 or the like, which is typically be an extension of a wet suit of the swimmer 10. Within the sleeve 18 is forearm 19 and wrist 21 of the swimmer 10 from which extends thumb 24 and other fingers 26 of hand 22. The batteries 16/16A are in electrical communication with motor power controller 28 (see FIG. 2-4 and electrical block diagram of FIG. 8) which in turn drives a brushless motor 29 and an impeller 32 using a drive shaft 34. The batteries of the system are, as above noted, designed to attach to the sleeve or propulsion unit and can be connected or disconnected by the swimmer under or above the surface of the water. A cable connection (see FIG. 8) to the batteries may be removed by pulling their connections apart from cable 31 or simply removing cable 37 from the battery pack at point 33.

The impeller 32 is surrounded by a shroud 36 which functions as a nozzle thereby affording protection to the diver and of the impeller from foreign objects with which it might otherwise become entangled. As well, shroud or nozzle 36 also assures proper directionality of the thrust output of the system.

Propulsion unit 30 is secured to sleeve 18 by a bracket 38 (see FIGS. 2 and 3) which bracket includes a flat integral radial segment 40. Beneath bracket 38 is a flat elongate member 42 (see FIG. 4) which is bonded or otherwise secured to bracket 38 and which extends upwardly to a control handle 44, more fully described below.

Between sleeve 18 and elongate member 42 is a planar surface 46 which is secured to sleeve 18. See FIG. 4. Conformal to surface 46 is said elongate member 42. A pivot element 48 (also referred to as a quick release pin) is secured at its base within surface 46 such that member 42 as well as its associated bracket 38 and the entire prolusion unit 30 is rotatable about the axis of pivot element 48 using control handle 44 as a lever. The quick release pin may be a Clevis pin, thus enabling the necessary quick release, as may be needed. Also see FIG. 7. In addition, the pivot element (quick release pin) 48 provides at least the following additional functions:

1. It secures the propulsion unit 30 (see FIG. 6) to the swimmer's arm 19 by joining the planar surface 46, elongate member 42 and bracket 38 where the quick release pin 48 is inserted and through each of said elements while also permitting the pivoting of the propulsion unit 30/32/36.

2. Disengagement and removal of the quick release pin 48 allows the separation of the planar surface 45, elongate member 42 and bracket 38, permitting the propulsion unit to separate from the swimmer if desired, while concurrently permitting pivoting to continue until pin 48 is removed.

All components, including the power unit, power supply and propulsion unit can reside and operate below the swimmer's elbow if no cables or physical connections along the swimmer's upper arm 19 or around his shoulders, neck, head, torso, hips, legs or feet exist.

Figure 4:
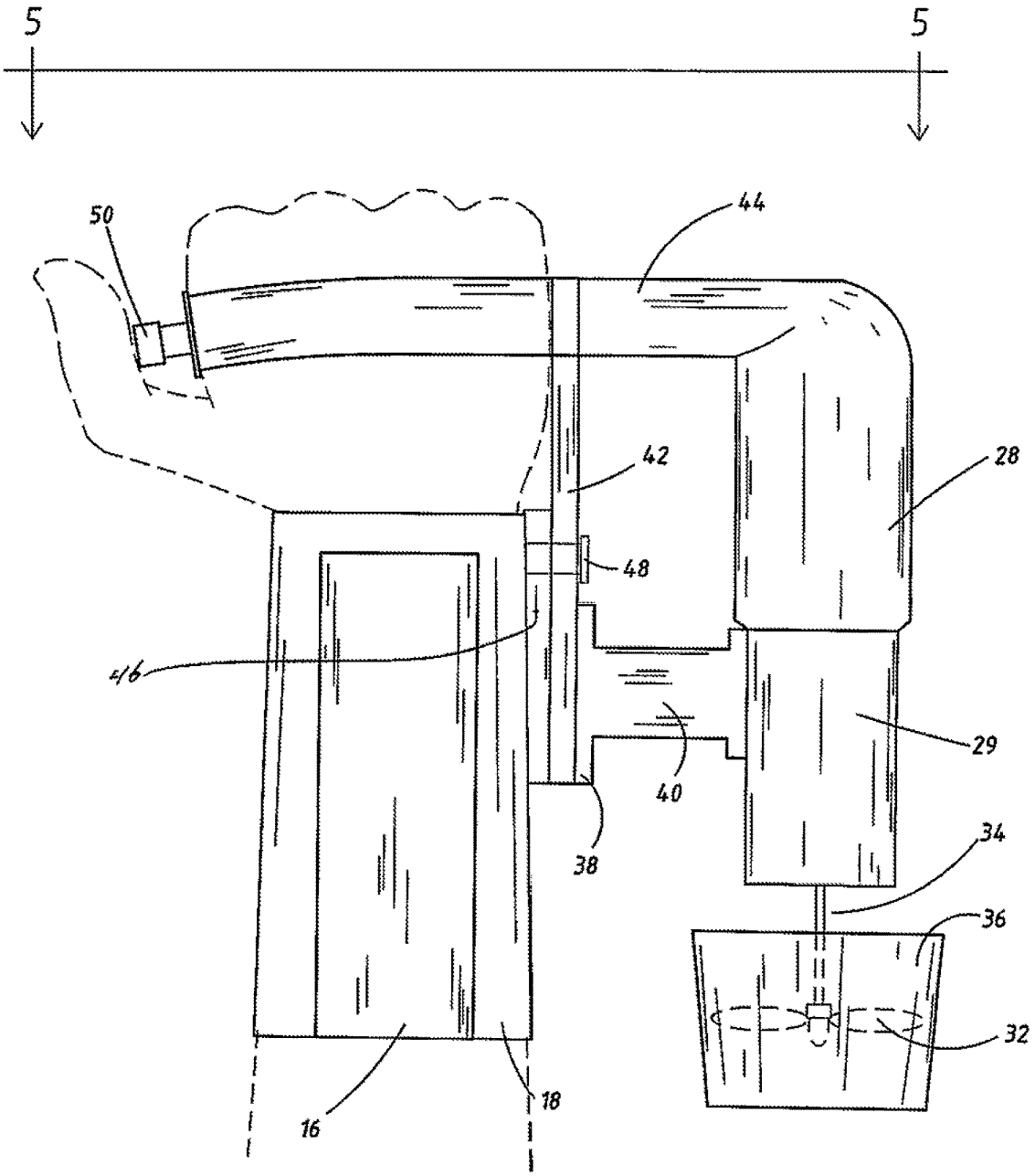
FIG. 4 is a top plan view showing the material components of the propulsion system, with certain integral elements thereof shown in phantom, and showing the Hall-effect switch proximally to a thumb of a hand of a swimmer and the control handle of the system engaged by the other fingers of the swimmer.
Figure 5:
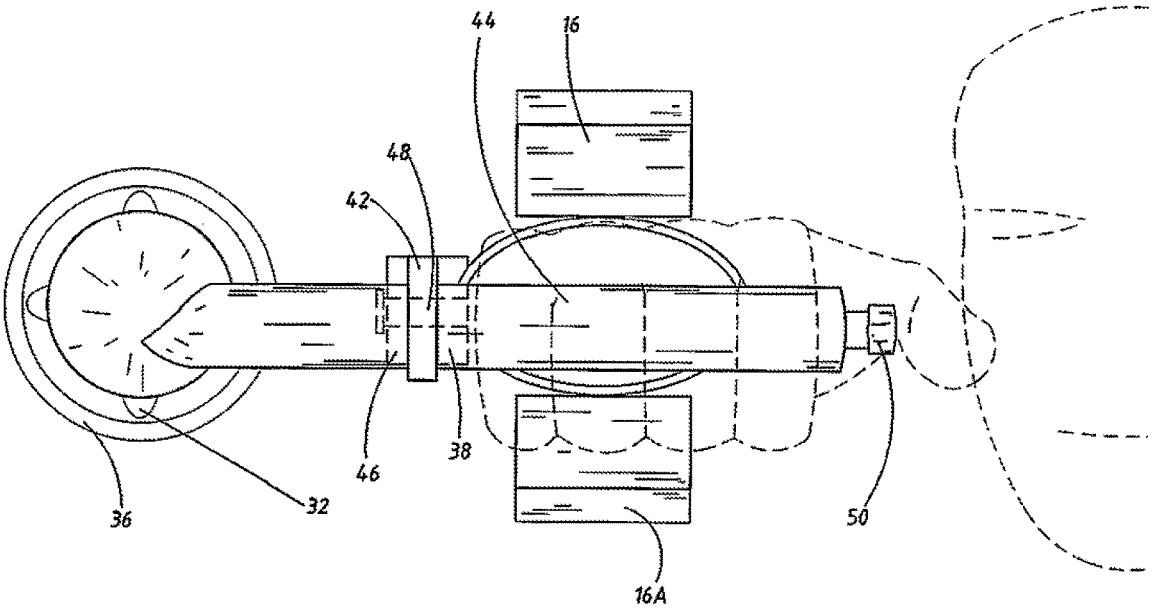
FIG. 5 is a front schematic view taken along Line 5-5 of FIG. 4.

A front view of the system along the axis of control handle 44 is shown in FIG. 5. Therein may also be seen Hall effect voltage controller 50. Depression of the button thereof regulates a pulsed width modulation (PWM) circuit 52 (see FIG. 8) which in turn acts on the motor power controller 28, which in turn regulates the DC power supplied by the power supply 16/16A to brushless motor 29 and, therewith, the extent of thrust that is generated by impeller 32. The electrical connections of block diagram of FIG. 8 are not shown in the mechanical renderings of FIGS. 2-7, which are well within the skill of one of ordinary skill in the art to provide in light of the disclosure herewith.

It is to be appreciated that Hall effect voltage controller 50, housed at a proximal end control handle stick 44, provides access by thumb 24 of the swimmer, either with or without use of one's other fingers 26. Further, it should be appreciated that pivot element 48 in combination with elongate member 42, and the elongated geometry of control handle 44, permit ease of mechanical rotation of the entire propulsion unit 30. See FIG. 4. That is, handle 44 in combination with member 42 permit the power unit 30 to be easily pivoted about said element 48. See FIG. 7.

Figure 3:
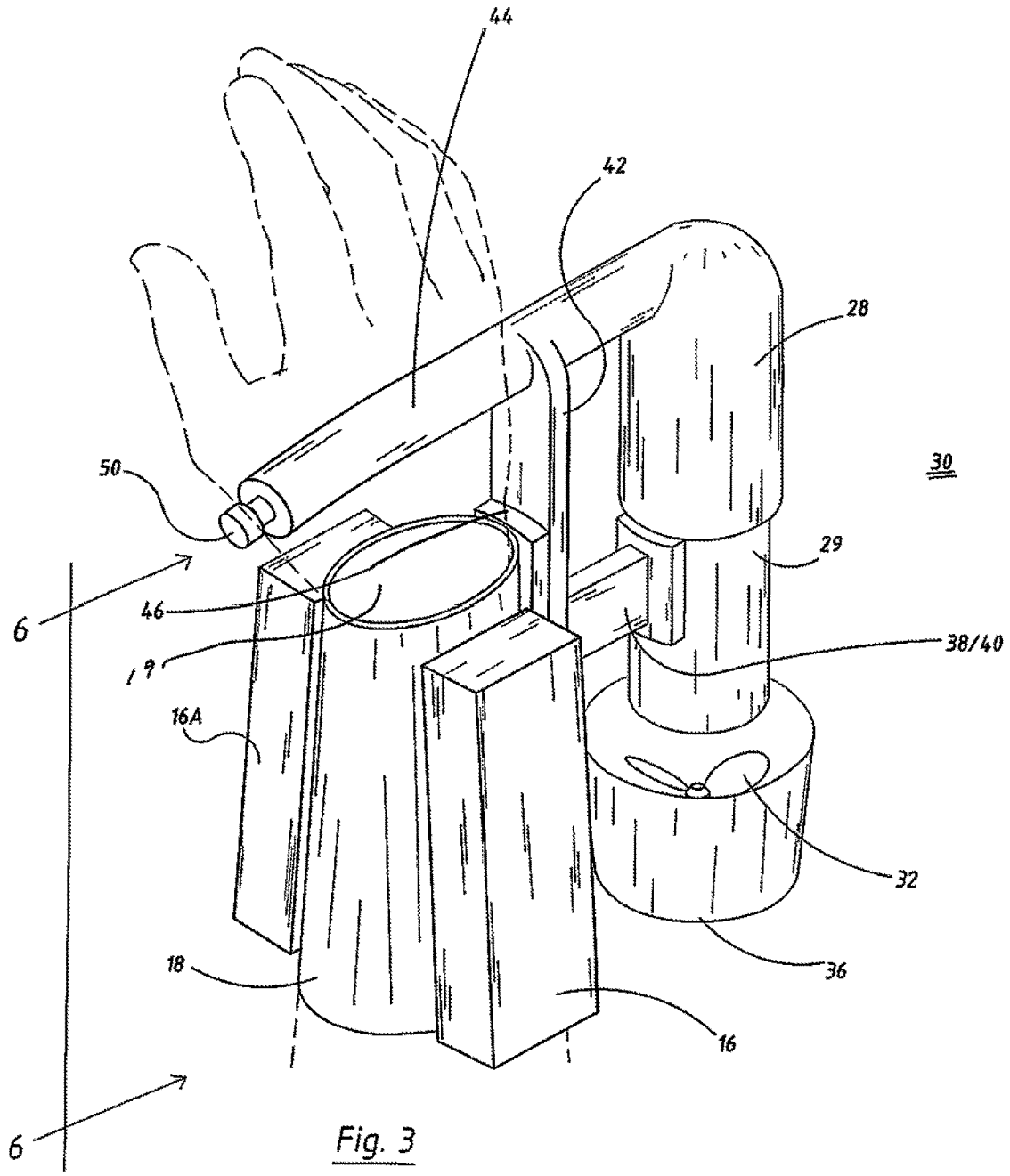
FIG. 3 is a view, generally similar to that of FIG. 2, however showing the location and manual control handle behind the hand of the user at such time when the use of the controls is not required by the swimmer.
Figure 6:
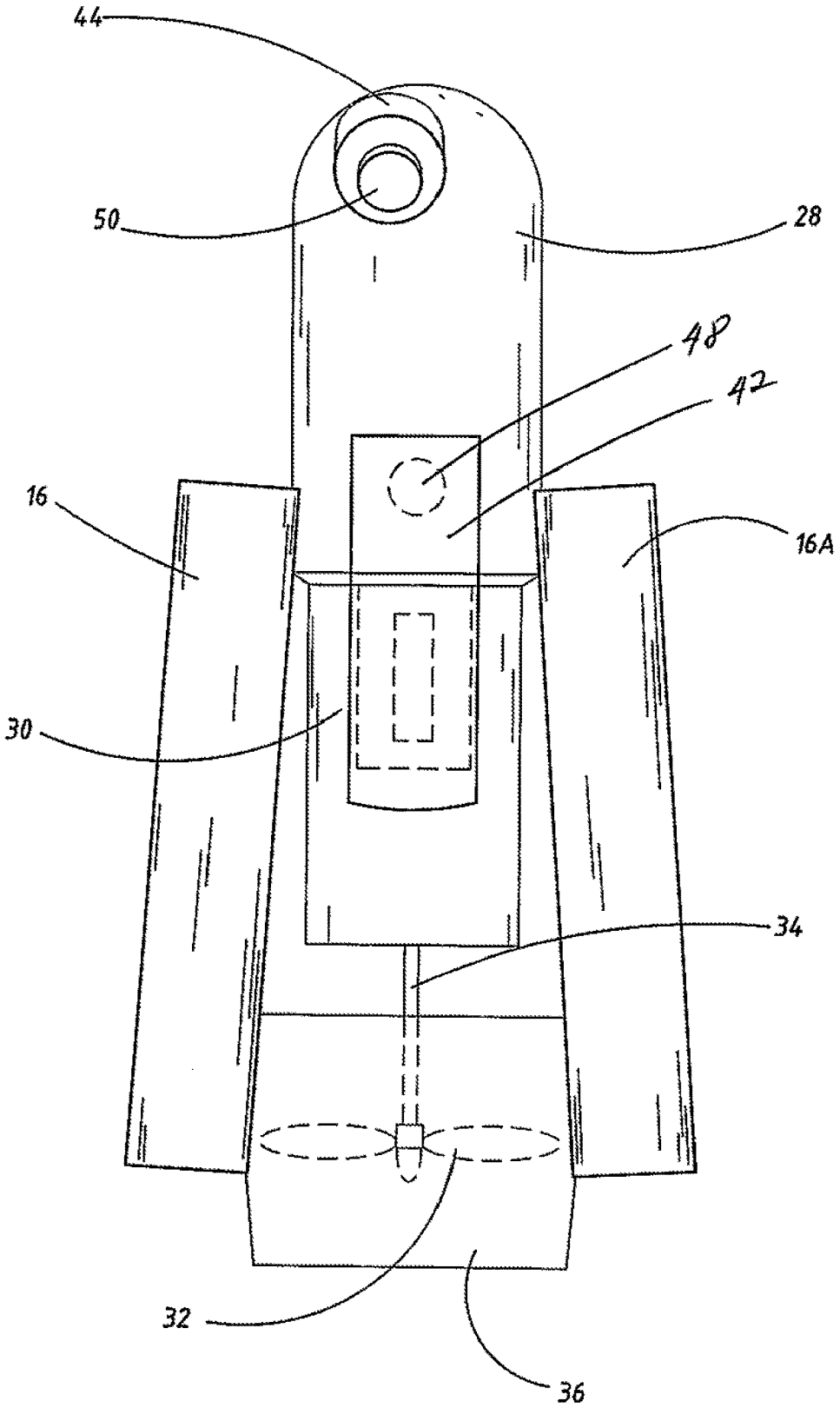
FIG. 6 is a side schematic view along Line 6-6 shown in FIG. 3.

FIG. 6 is a side view taken along the axis of control handle 44 in the direction shown along Line 6-6 of FIG. 3.

Figure 7:
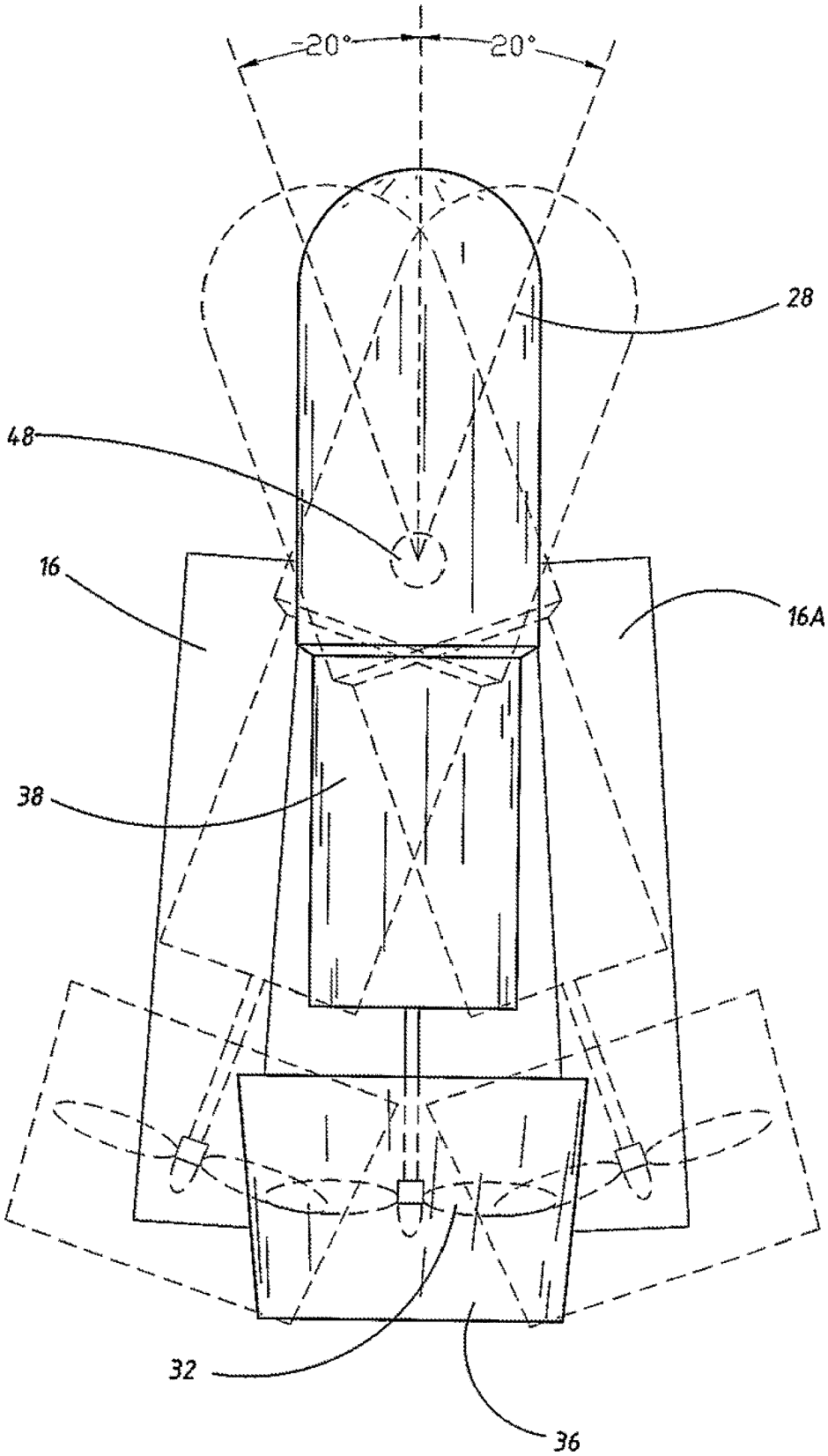
FIG. 7 is a conceptual view showing, in phantom, the rotation of the propulsion unit which is attached to the forearm of the swimmer using the mechanism for control of the pitch of the longitudinal axis of the propulsion unit, particularly showing a resulting tilting of a 20-degree wrist flexion of the swimmer relative to a pivot point of the system and, in phantom, a counterclockwise rotation of the propulsion unit relative to the forearm of the swimmer, the same corresponding to a minus 20 degree wrist flexion about the pivot point.
Figure 8:
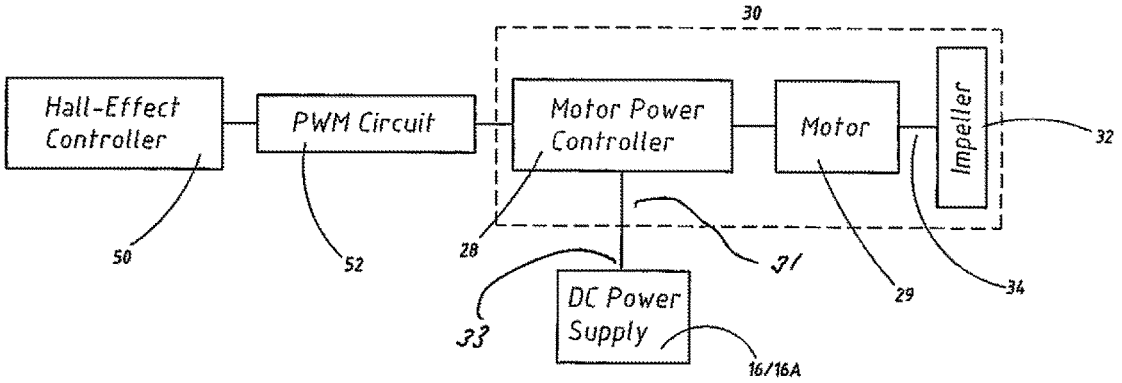
FIG. 8 is a general system component layout showing the inter-relationship of all electrical components of the instant invention.

With respect to FIG. 7, there may be seen positive and negative angulations of degrees of pitch of the propulsion unit that may be readily accomplished by extension or flexion of the wrist of the swimmer while engaging control handle 44. This, among other aspects, differs from the teaching of Bruce above (U.S. Pat. No. 5,024,178) in that positioning requiring movement of the shoulder or elbow of the swimmer is not necessary. Rather, one need only engage control handle 44 with the hand while flexing or extending the wrist to accomplish changes in degree of pitch of the propulsion unit, shown in FIGS. 7 and 8. Using the thumb, the Hall effect voltage controller 50 is also able to also control the degree of thrust generated by the instant system. As such, both to the pitch, either negative or positive relative to the axis of the body of the swimmer, as well as the thrust output of impeller 32, may be readily controlled by simple movements of the hand, wrist and forearm of the swimmer.

If desired, a similar assembly may be provided upon the other forearm of a swimmer, the controls of which may be operated independently of those upon the first forearm of the swimmer.

With further regard to the electrical block diagram of FIG. 8, in a preferred embodiment, the PWM signal of circuit 52 will define a frequency of about 50 Hertz and include modulated pulses having a width of between about 1 and about 2 milliseconds, with a repetition of such pulses of about 20 milliseconds each. Further, through the use of Hall effect controller 50, the output voltage of DC power supply 16/16A will fall within a range of 0 to about 30 volts DC.

Many of the components of the present system are readily available to the public. For example, an appropriate Hall effect switch, providing a linear output using a push button control is sold by Otto Engineering of Carpentersville, Ill. 60110. An appropriate thruster corresponding to elements 32, 36 and 40 above is sold by CrustCrawler of Gilbert, Ariz. 85233. An appropriate product of CrustCrawler is their 50 volt rated 400 HFS-L high-flow thruster. Other suitable thrusters, such as the Sea Botix 150, are sold by Hollis Gear of Irvine, Calif. Further, an appropriate brushless DC motor may be purchased from CrustCrawler.

In view of the above, it is to be appreciated that there is provided a propulsion system in which the power source thereof is self-contained and which may be readily positioned relative to the forearm of the swimmer without need for any anatomical intervention other than that of the use of a wrist and hand of one arm of the swimmer. This excludes the need for any form of external electrical or mechanical connection beyond the immediate area of the propulsion unit that constitutes a risk factor in prior art solutions such as that of Bruce, above.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What is claimed:

1. An underwater propulsion system comprising:

a sleeve securable about a forearm of a user;

a propulsion unit pivotably secured to the sleeve about a pivot axis, the propulsion unit providing a hydrodynamic thrust in a thrust direction, wherein the thrust direction is orthogonal to the pivot axis;

a power supply unit providing electrical power to the propulsion unit; and a control handle coupled to the propulsion unit for manipulation by the user.

2. The propulsion system of claim 1, wherein the pivotable connection between the propulsion unit and the sleeve allows positive and negative pitch angulations of the propulsion unit relative to the forearm of the user resulting from extension or flexion of the user's wrist while engaging the control handle.

3. The propulsion system of claim 2, wherein the propulsion unit is pivotably secured to the sleeve by a bracket, the bracket comprising:

a first member secured to the sleeve;

a second member secured to the propulsion unit; and a pivot element pivotably connecting the second member to the first member, the pivot element extending through the second member and defining a pivot axis about which the second member and propulsion unit rotate upon manipulation of the control handle by the user.

4. The propulsion system of claim 3, wherein the pivot element is a quick release pin allowing the propulsion unit to be selectively disconnected from the sleeve.

5. The propulsion system of claim 3, wherein the second member is also secured to the control handle.

6. The propulsion system of claim 1, wherein the control handle comprises a power control button, the power control button operable to control the amount of electrical power provided by the power supply unit to the propulsion unit.

7. The propulsion system of claim 6, wherein the power control button is engageable by the user's thumb while the control handle is manipulated by the user.

8. The propulsion system of 7, wherein both the pitch angulation of the propulsion unit relative to the user's forearm and a thrust output of the propulsion unit are controlled by hand and wrist movements of the user.

9. The propulsion system of claim 1, wherein the propulsion unit extends in a direction laterally offset from the user's forearm.

10. The propulsion system of claim 1, wherein the power supply unit is secured to sleeve.

11. The propulsion system of claim 1, wherein the propulsion unit comprises:

a motor in electrical communication with the power supply unit;

an impeller connected to the motor; and a shroud covering the impeller and defining a nozzle.

12. The propulsion system of claim 1, wherein the power supply unit comprises one or more DC batteries.

13. An underwater propulsion system comprising:

a sleeve securable about a forearm of a user;

a propulsion unit positioned to extend in a direction laterally offset from the user's forearm, the propulsion unit coupled to the sleeve by a housing segment extending therebetween;

a power supply unit providing electrical power to the propulsion unit; and a control handle for manipulation by the user, the control handle including a power control button operable to control the amount of electrical power provided to the propulsion unit by the power supply unit, the control handle extending from the propulsion unit and defining a handle grip that is grasped by the user for manipulation thereof.

14. The propulsion system of claim 13, wherein the power control button is engageable by the user's thumb while the control handle is manipulated by the user.

15. The propulsion system of claim 13, wherein the power supply unit is electrically connected to the propulsion unit by a cable connection.

16. The propulsion system of claim 13, wherein the connection between the sleeve and the propulsion unit allows positive and negative pitch angulations of the propulsion unit relative to the user resulting from hand, wrist, or forearm movement of the user.

17. An underwater propulsion system comprising:

a propulsion unit positioned to extend in a direction laterally offset from a user's forearm;

a power supply unit providing electrical power to the propulsion unit; and a control handle for manipulation by the user to vary the pitch angulation of the propulsion unit relative to the user, the control handle including a power control button operable to control the amount of electrical power provided by the power supply unit to the propulsion unit, wherein the power supply unit is positioned to extend in a direction laterally offset from the user's forearm.

18. The propulsion system of claim 17, wherein at least a portion of the control handle is positioned between the propulsion unit and the power supply unit.

19. The propulsion system of claim 17, wherein the power supply unit and the propulsion unit are positioned to extend adjacent to different sides of the user's forearm.

20. The propulsion system of claim 13, wherein the propulsion unit is pivotably secured to the sleeve about a pivot axis, the propulsion unit provides a hydrodynamic thrust in a thrust direction, and the thrust direction is orthogonal to the pivot axis.

* * * * *